US006648343B2

(12) United States Patent
Way et al.

(10) Patent No.: US 6,648,343 B2
(45) Date of Patent: Nov. 18, 2003

(54) STAIR CHAIR

(75) Inventors: Christopher B. Way, Richland, MI (US); Clifford E. Lambarth, Portage, MI (US); Joshua C. Colvin, Kalamazoo, MI (US)

(73) Assignee: Stryker Corporation, Kalamazoo, MI (US)

( * ) Notice: Subject to any disclaimer, the term of this patent is extended or adjusted under 35 U.S.C. 154(b) by 131 days.

(21) Appl. No.: 10/046,441

(22) Filed: Jan. 14, 2002

(65) Prior Publication Data

US 2003/0132585 A1 Jul. 17, 2003

(51) Int. Cl.[7] ..... B65B 5/02

(52) U.S. Cl. ..... 280/5.22; 280/250.1; 280/304.1; 280/650

(58) Field of Search ..... 280/5.2, 5.22, 280/5.24, 5.28, 250.1, 304.1, 295, 297, 298, 300, 301, 303, 647, 650, 657, 658

(56) References Cited

U.S. PATENT DOCUMENTS

| | | | | |
|---|---|---|---|---|
| 1,087,928 A | * | 2/1914 | Diemer | 280/650 |
| 4,473,234 A | | 9/1984 | Egen | |
| 4,962,941 A | * | 10/1990 | Rembos | 280/5.22 |
| 5,338,048 A | | 8/1994 | Medina | |
| 5,390,389 A | * | 2/1995 | Rutkowski et al. | 280/5.22 |
| 6,343,805 B1 | * | 2/2002 | Roy | 280/250.1 |

FOREIGN PATENT DOCUMENTS

WO WO 01/08624 A1 2/2001

OTHER PUBLICATIONS

Product Brochure for IBEX TRANSEAT; 21st Century Medical Ltd; 1999; 2 pages.

* cited by examiner

*Primary Examiner*—Lesley D. Morris
*Assistant Examiner*—Matthew Luby
(74) *Attorney, Agent, or Firm*—Flynn, Thiel, Boutell & Tanis, P.C.

(57) ABSTRACT

The present invention is directed to a stair chair. The stair chair includes a seat assembly mounted to a main frame and configured to pivot about a first pivot axis. A rail assembly having two laterally spaced brackets provided at a lower end of the rail assembly is included. A back wheel is rotatably supported on each bracket for rotation about a common axis of rotation. At least two mounts are provided at a lower end of the main frame, each of which is configured to pivotally connect one of the brackets to the main frame for movement about a second pivot axis. The rail assembly and seat assembly are configured to pivot about their respective pivot axes independent of movement of one another. A first spacing exists between the axis of rotation of the front wheels and the axis of rotation of the back wheels when the rail assembly in a retracted position and a second spacing exists between the axis of rotation of the front wheels and the axis of rotation of the back wheels when the rail assembly in a deployed position.

15 Claims, 13 Drawing Sheets

STAIR CHAIR

FIELD OF THE INVENTION

This invention relates generally to stair chairs and, more particularly, to stair chairs including a seat assembly and a rail assembly configured so that the seat assembly and the rail assembly can pivot about respective pivot axes independent of movement of one another.

BACKGROUND OF THE INVENTION

For a number of people, climbing stairs is a difficult, if not impossible, task. When there is no alternative to the stairs for exiting a building, such as in an evacuation situation, or moving between the floors of a multi-level building, assistance is often required. Several chairs, typically referred to as stair chairs in the art, have been developed which are configured to move a person in need up or down stairs.

Conventional stair chairs include a main frame to which a seat assembly and a rail assembly are mounted. The rail assembly includes a roller, endless track, or other suitable mechanism to facilitate movement of a person down the stairs. The seat and rail assemblies of these conventional stair chairs are configured to pivot together between retracted and deployed positions. Thus, the standard stair chair has two orientations, a first in which the seat and rail assemblies are deployed and a second in which the seat and rail assemblies are retracted. Therefore, the rail assembly must be maintained in a deployed position, thereby making it difficult to move a patient in the stair chair over a level surface or up one or more steps. Further, due to the combined weight of the stair chair and a passenger, the chair cannot be pulled up stairs on the rails. Thus, two people are needed to lift the conventional stair chair and carry it up the entire flight of stairs since the rail assemblies cannot be retracted when the seat assembly is deployed.

While a number of people have benefited from the aid of conventional stair chairs, these devices can be further improved. In addition to the configuration limitation illustrated above, typical stair chairs tend to have a relatively small wheel base due to the fixed position of the wheels. Commonly, front wheels are attached near the front of the chair and back wheels that are attached to the main frame. When the stair chair is in the deployed position, the rail assembly projects from the back of the main frame, leaving the main frame located near the middle of the stair chair. This relatively small wheel base can result in an instability of the stair chair when it is sitting on, or being moved along, a level surface.

SUMMARY OF THE INVENTION

This invention is directed to a new and useful stair chair including a main frame. A seat assembly is mounted on the main frame and is configured to pivot about a first pivot axis. The seat assembly includes a seat and a support frame that are pivotally mounted to the main frame, wherein at least two laterally spaced front wheels are rotatably attached to a lower end of the support frame. A rail assembly including two laterally spaced brackets provided at a lower end of the rail assembly is included. Each bracket has a back wheel rotatably supported thereon for rotation about a common axis of rotation. At least two mounts are provided at a lower end of the main frame, each of the mounts is configured to pivotally connect one of the brackets to the main frame for movement about a second pivot axis. The rail assembly is configured to pivot about the second pivot axis independent of movement of the seat assembly and the seat assembly is configured to pivot about the first pivot axis independent of movement of the rail assembly. A first spacing exists between the axis of rotation of the front wheels and the axis of rotation of the back wheels when the rail assembly is in a retracted position and a second spacing exists between the axis of rotation of the front wheels and the axis of rotation of the back wheels when the rail assembly is in a deployed position.

BRIEF DESCRIPTION OF THE DRAWINGS

This invention is pointed out with particularity in the accompanying claims. The above and further features and benefits of this invention are better understood by reference to the following detailed description, as well as by reference to the following drawings in which:

DETAILED DESCRIPTION

Figure 1:
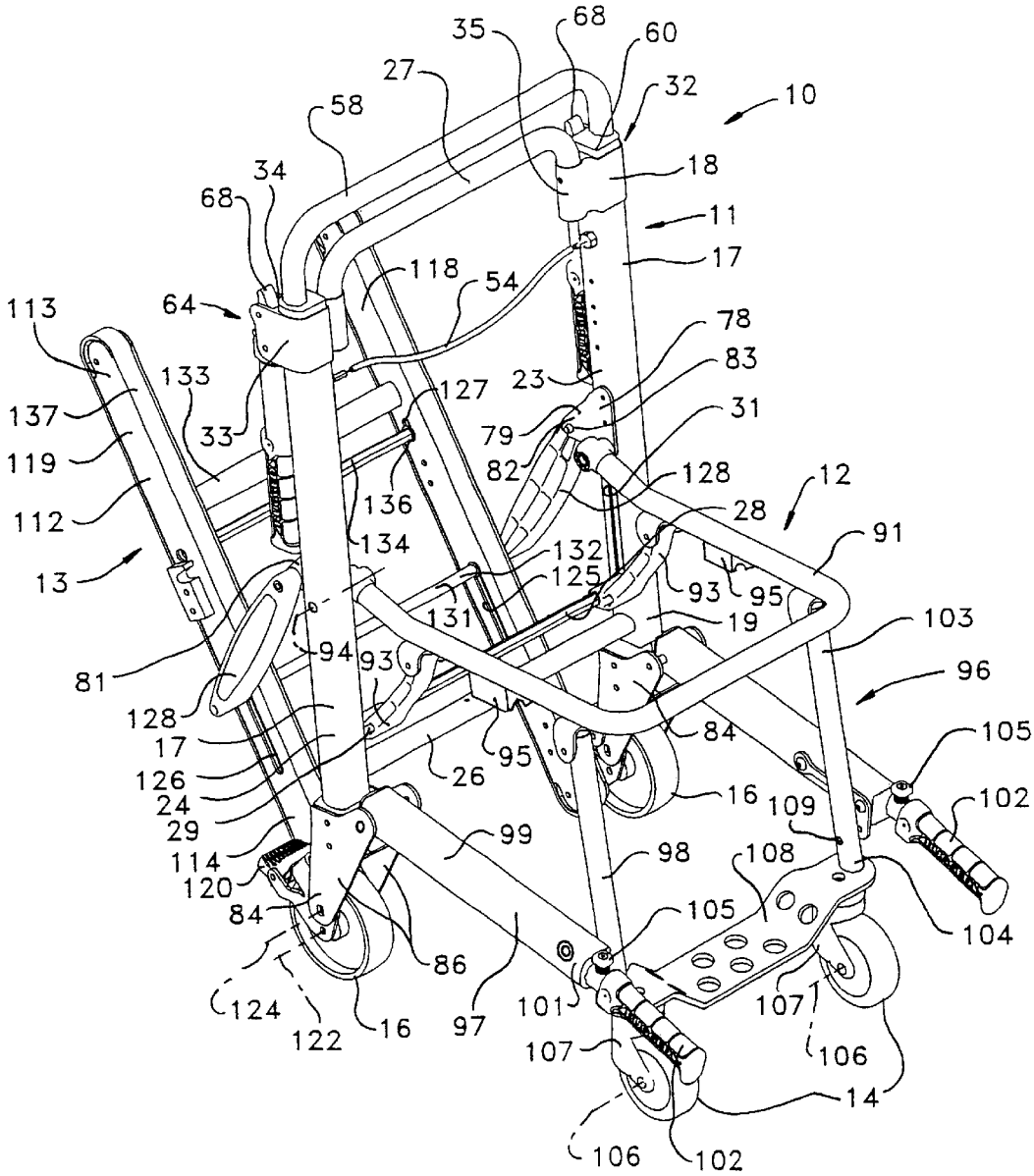
FIG. 1 is an elevational perspective view of a stair chair according to the present invention.

Referring to FIG. 1 there is illustrated a stair chair 10 according to the present invention. The stair chair 10 includes a main frame 11, on which a seat assembly 12 and a rail assembly 13 are pivotally mounted. The stair chair 10 is supported by two front wheels 14 and two back wheels 16.

The main frame 11 includes two laterally spaced uprights 17. The uprights 17 are tubular members having a generally rectangular cross-section, each of which has an upper end 18 and a lower end 19. Each upright 17 has a front surface 21 (FIG. 2), a back surface 22 (FIG. 2), an inner-facing side surface 23 and an outer-facing side surface 24. The uprights are coupled together by a rod 26 that is attached to the inner-facing surfaces 23 of the uprights 17 near their respective lower ends 19 and a fixed handle 27 interconnecting the upper ends 18. A rod 28 extends between the uprights 17. The rod 28 has ends 29 that are slidable in tracks 31 in the inner-facing surfaces 23 of each of the uprights 17. While not illustrated, the bottom of each track 31 is inclined so that the respective end 29 of the rod can be locked in position at the bottom of the tracks 31.

Figure 5A:
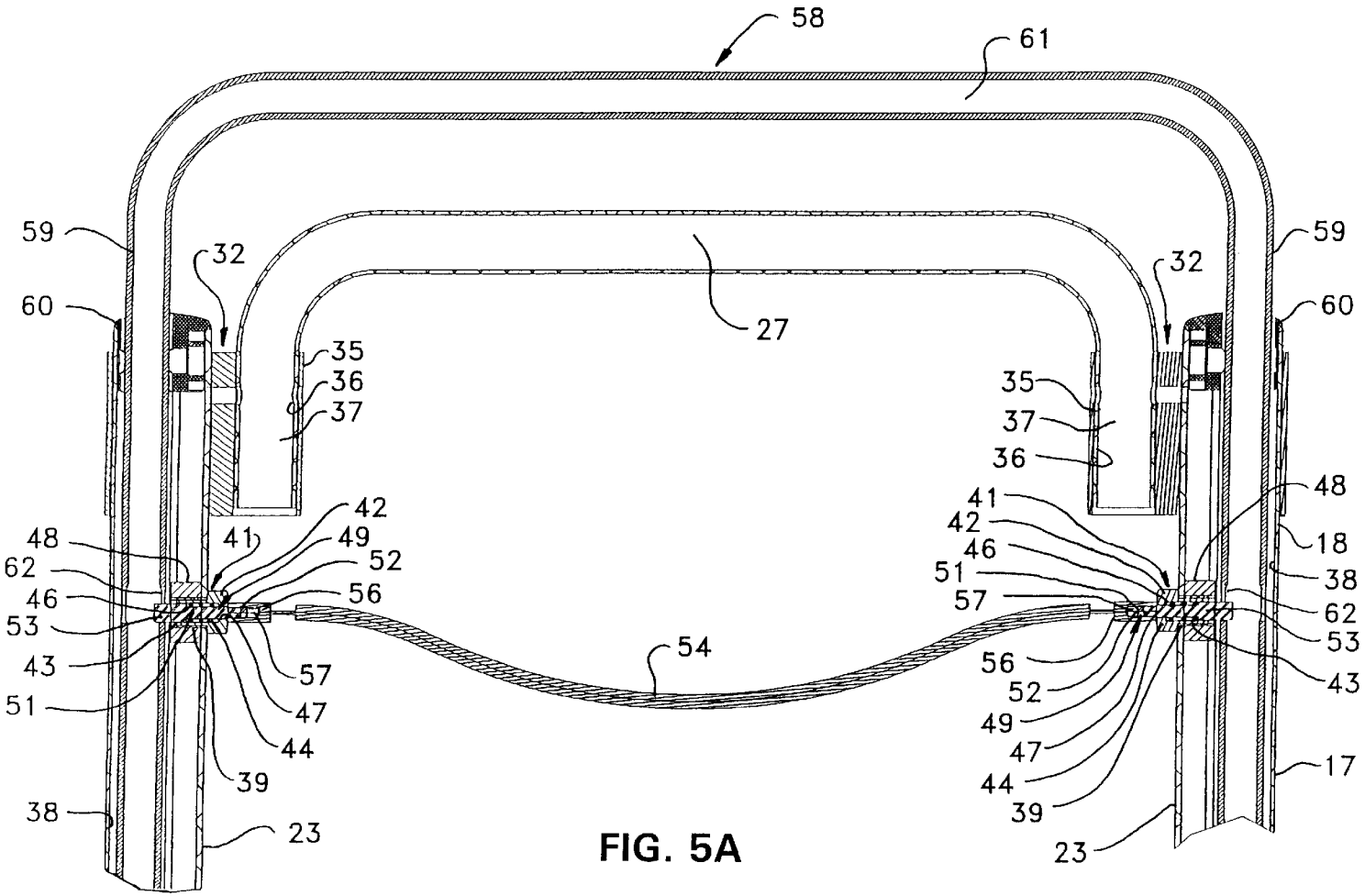
FIG. 5A is a sectioned front view of the top portion of the stair chair of FIG. 1 with the grab handle in the retracted position.
Figure 5B:
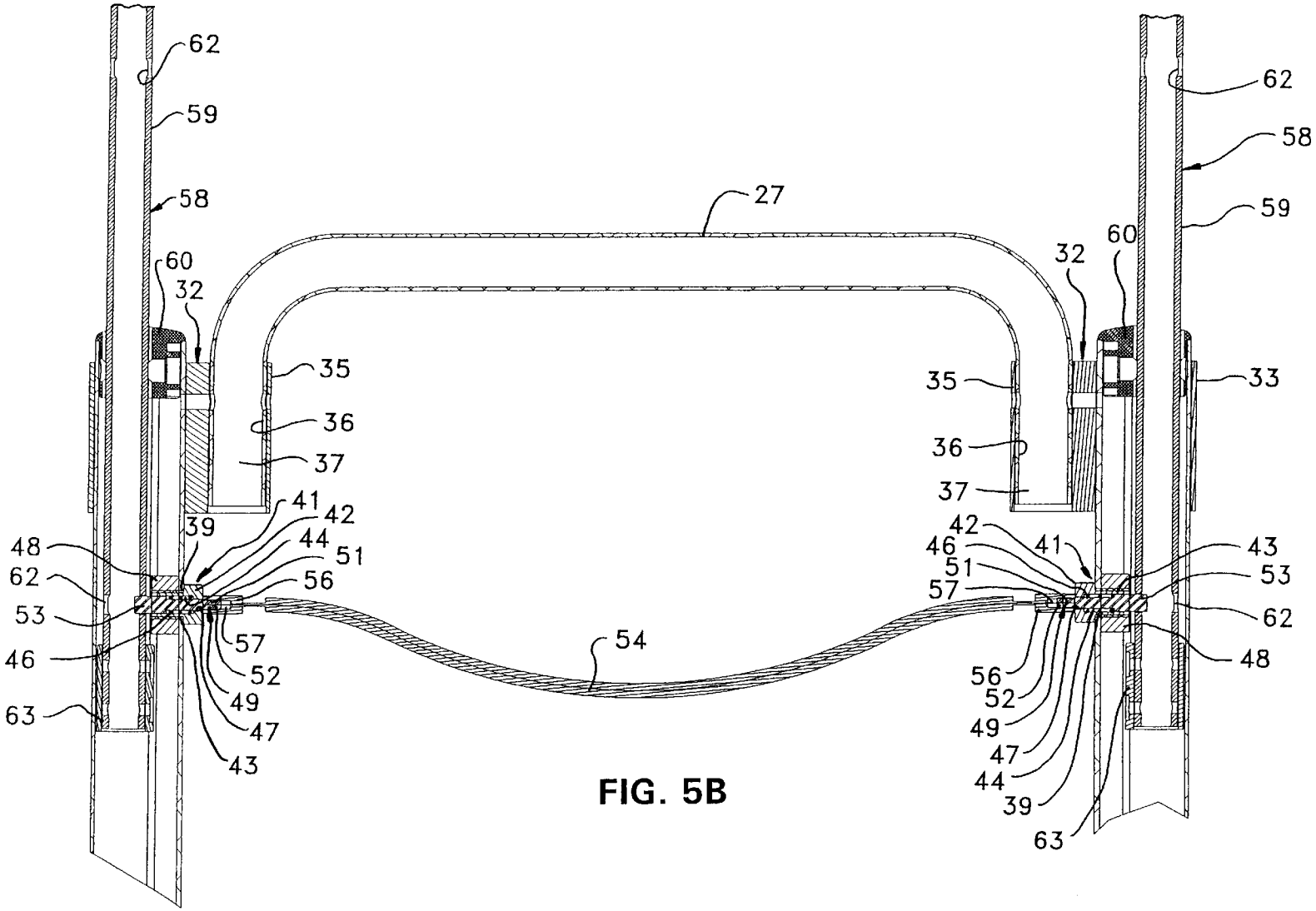
FIG. 5B is a sectioned front view of the top portion of the stair chair of FIG. 1 with the grab handle in the fully extended position.

A bracket 32, which is preferably extruded, is attached to the upper end 18 of each upright 17 by a suitable means, such as welding. Each bracket 32 includes two spaced apart arms 33 and 34 that extend rearward from the stair chair 10, beyond the back surface 22 (FIG. 2) of the associated upright 17. As best illustrated in FIGS. 5A and 5B, the bracket 32 also includes a side extension 35 that forms an opening 36. Each end 37 of the handle 27 is received in one of the openings 36 and welded to one of the side extensions 35.

Referring to FIG. 5A, the upper end 18 of each upright 17 is hollow and includes an upwardly opening recess 38. Axially aligned bores 39 extend through the inner side surface 23 of the upper end 18 of each upright 17 into the respective recess 38. As illustrated, a T-shaped stop piece 41 is attached near the upper end 18 of the respective upright 17. The stop piece 41 includes a head 42 that is positioned adjacent the inner-facing side surface 23 of the respective upright 17. The stop piece 41 also includes a shank 43 that extends from the head 42 through the bore 39 and into the associated recess 38. The stop piece 41 includes a spring cavity 44 in which is positioned a coil spring 46. A central orifice 47 extends through the head 42 and opens into the spring cavity 44. A nut 48 surrounds the portion of the shank 43 that extends into the recess 38. The nut 48 is attached to the shank 43 in a suitable manner, such as by a complementary thread arrangement on the shank 43 and the nut 48.

A bit 49 is partially positioned in each stop piece 41 and is slidable therein. Each bit 49 includes an elongate shank 51 having a threaded end 52 and a head 53. The threaded end 52 of each shank 51 extends through the central orifice 47 of the respective stop piece 41. The head 53 is slidably received in the spring cavity 44 of the associated stop piece 41. When the bit 49 is inserted into the respective stop piece 41, the spring 46 is positioned between a bottom of the spring cavity 44 and a shoulder on the head 53. The spring 46 urges the head 53 of the respective bit 49 into the associated recess 38.

A flexible connector 54 extends between the uprights 17. End caps 56 are positioned on either end of the connector 54. Each end cap 56 includes a cavity 57 that has a set of inner threads. The threaded end 52 of the shank 51 is received in the cavity 57 of the respective end cap 56 and is attached thereto by a mating of the complementary thread arrangements. When the connector 54 is pulled, the bits 49 are pulled toward the center of the stair chair 10 so that the respective heads 53 are pulled against the urging of the springs 46.

A U-shaped handle 58 extends between the uprights 17. The handle 58 includes two end segments 59 that are separated by a central portion 61. Each end segment 59 of the handle 58 is slidably received in one of the upper recesses 38 in the uprights 17. A bushing 60 is attached to the top of each upright 17. The bushing 60 forms an opening through which the respective end segment 59 can slide. The openings of each bushing 60 are sized and shaped virtually equal to the outer perimeter of the respective end segment 59 so that the handle 58 does not wobble with respect to the uprights 17. As illustrated in FIGS. 5A and 5B, a number of bores 62 extend through each of the end segments 59 of the handle 58. Each bore 62 is equal in diameter, or slightly larger in diameter, to the head 53 of the stop piece 41 attached to the associated upright 17. Bushings 63 (FIG. 5B) are positioned around the lower portion of each of the handle end segments 59. The outer perimeter of each bushing 63 is approximately equal to the inner perimeter of the recess 38 of the associated upright 17. As with the bushings 60, the bushings 63 are sized and shaped to prevent the handle 58 from wobbling with respect to the uprights 17.

Figure 6C:
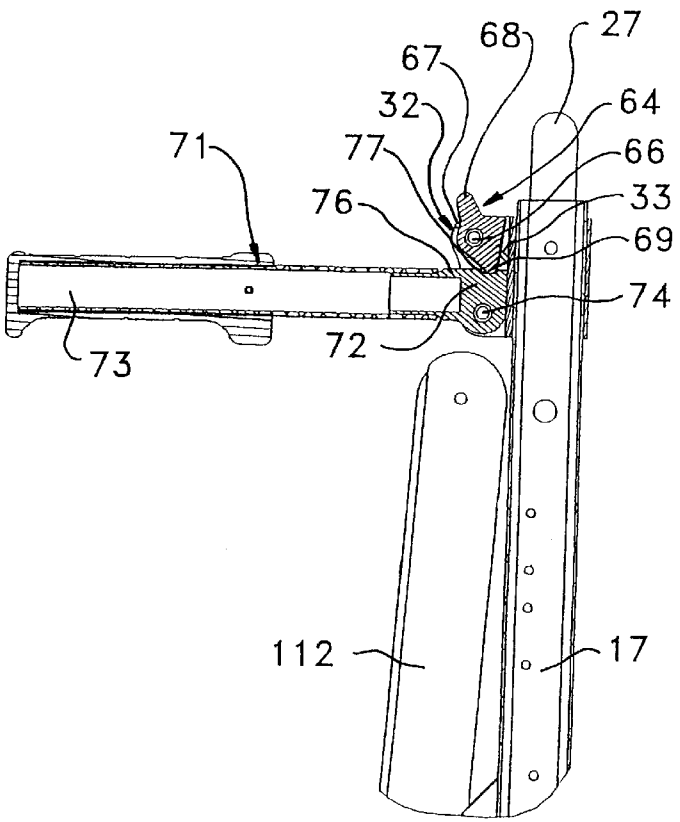
FIG. 6C is a sectioned side view of the handle of the stair chair of FIG. 1 locked in a use position.
Figure 6B:
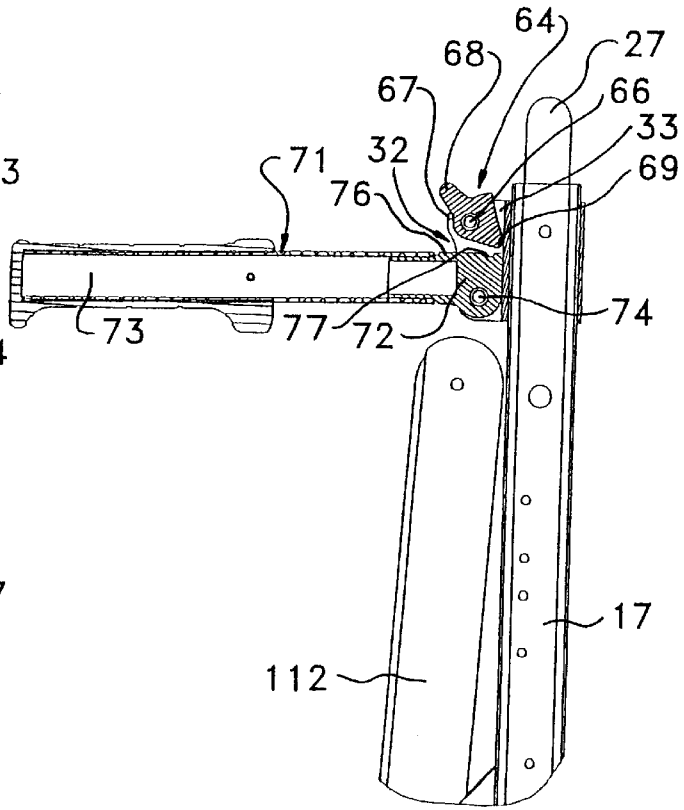
FIG. 6B is a sectioned side view of the handle of the stair chair of FIG. 1 released from the use position.
Figure 6A:
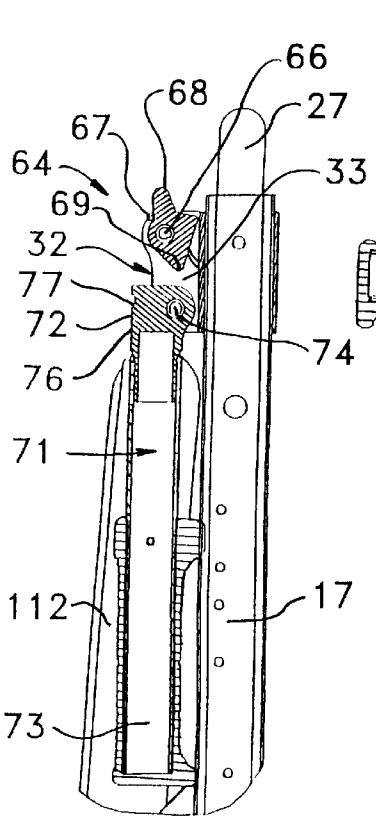
FIG. 6A is a sectioned side view of the handle of the stair chair of FIG. 1 in a rest position.

Referring now to FIGS. 6A–6C, a locking element 64 is secured between the arms 33 and 34 (FIG. 1) of each bracket 32 by a suitable fastener, such as a bolt. Each fastener forms a pivot axle 66 for its associated locking element 64. Each locking element 64 is configured to pivot about its respective pivot axle 66 between a first position (FIGS. 6A and 6C) and a second position (FIG. 6B). Each locking element 64 is continuously urged toward its first position by a biasing spring 67, which is preferably a torsion spring. Each locking element 64 includes an upper tab end 68 that extends upward beyond the top of the associated bracket 32 and a lower latch end 69. When one of the locking elements 64 is in its first position, the tab end 68 is biased to a generally vertical position, as illustrated in FIGS. 6A and 6C. To move the locking element 64 toward its second position, the tab end 68 is pulled downward, away from the associated upright 17 against the bias of the spring 67, causing the locking element 64 to pivot about its pivot axle 66 to its second position, as illustrated in FIG. 6B.

A handle 71 is coupled to each of the uprights 17. Each handle 71 has a first end 72 and a second end 73. The first end 72 of each handle 71 is secured to each bracket 32 between the associated arms 33 and 34 by a suitable fastener, such as a bolt. The fastener forms a pivot axle 74 about which the respective handle 71 can pivot. Each handle 71 is configured to pivot about its respective axle 74 between a rest, or retracted, position parallel to the associated upright 17 (FIG. 6A) and a use, or deployed, position projecting outward from the back of the stair chair 10 (FIGS. 6B and 6C). The top surface 76 of each handle 71 includes a notch 77, or another suitable indentation, adjacent the pivot axle 74.

Returning to FIG. 1, a bracket 78 is secured to the inner-facing side surface 23 of each of the uprights 17, near the mid-section of the associated upright 17. Each bracket 78 has an inner-facing surface 79 and an outer-facing surface 81. Each bracket 78 has an end 82 that is oriented rearwardly of the back surface 22 of the respective upright 17. A knob 83 projects from the end 82 of each of the brackets 78 on the inner-facing surface 79.

Figure 2:
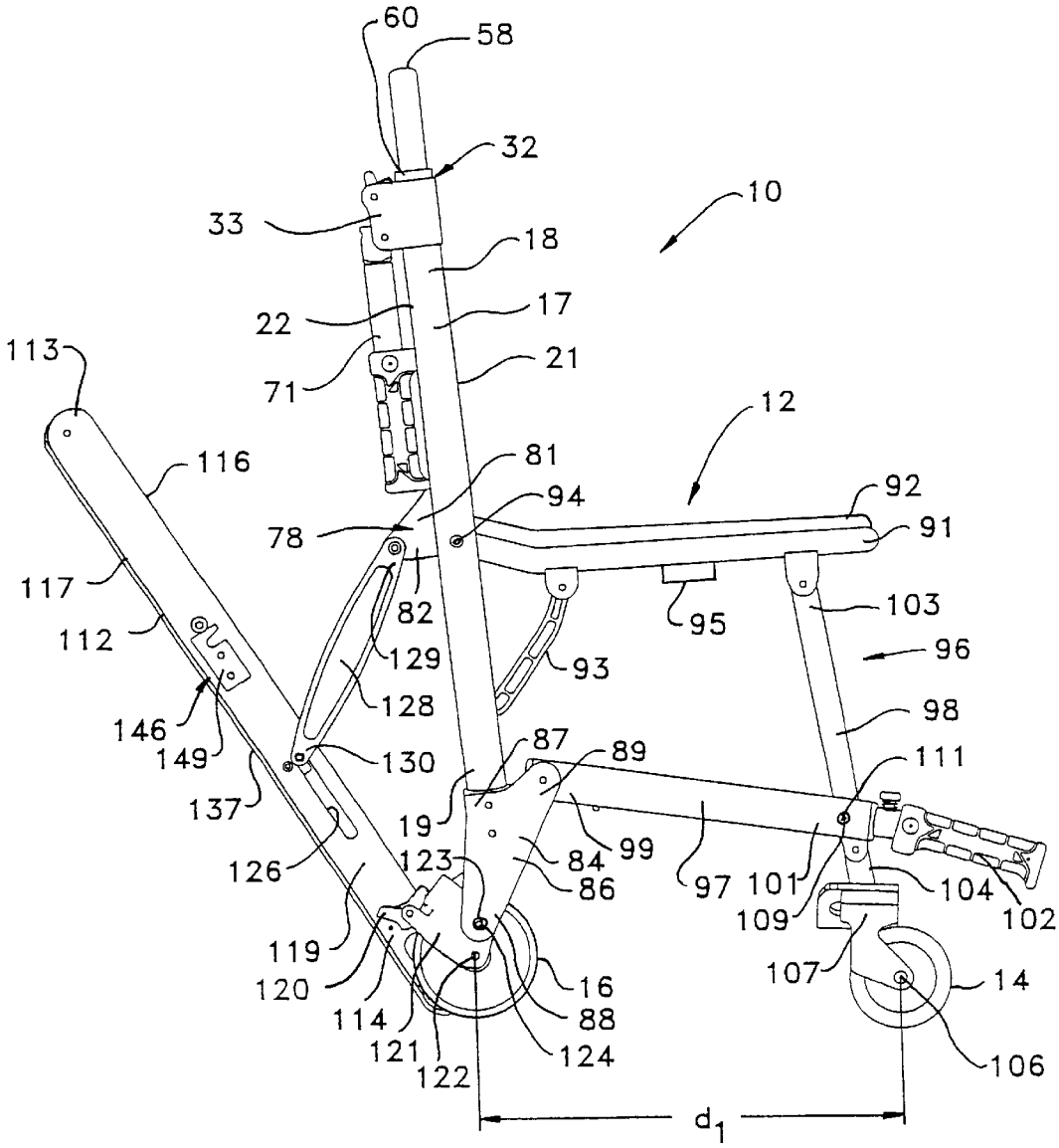
FIG. 2 is a side view of the stair chair of FIG. 1 in a fully deployed position.

Secured to the lower end 19 of each upright 17 is a mount 84. Each mount 84 has a generally triangular shape and has arms 86 that are adjacent the inner-facing and outer-facing surfaces 23 and 24 of their associated upright 17. Referring to FIG. 2, a first corner 87 of each arm 86 of the mounts 84 is secured to the respective upright 17 adjacent a lower end thereof. A second corner 88 of each arm 86 of the mounts 84 is spaced downwardly from the lower end of the upright 17. A third corner 89 of each arm 86 of the mounts 84 is oriented frontwardly of the front surface 21 of the upright 17.

Referring now to FIGS. 1 and 2, the seat assembly 12 includes a U-shaped frame 91 (FIG. 1) that is secured to the inner facing surface 79 of the bracket 78 by a suitable fastener. A seat 92 (FIG. 2) is supported by the frame 91. The seat assembly 12 includes a seat back 90 (FIG. 11) that is mounted on the uprights 17 and the handle 27. The seat 92 and the seat back 90 are omitted from FIG. 1 to provide a more clear illustration of other components of the stair chair 10. Brace members 93 extend between mid-length portion of the seat frame 91 and the rod 28 which extends between the uprights 17. The brace members 93 are pivotally attached to both the frame 91 and the rod 28, to allow the frame 91 and the seat 92 to pivot about a pivot axis 94 (FIG. 2) with respect to the uprights 17 between a retracted position (FIGS. 3 and 4B) and a deployed position (FIGS. 1, 2 and 4A).

The seat assembly 12 also includes a support frame 96. Referring to FIG. 2, the support frame 96 includes two laterally spaced apart and parallel support arms 97 and two laterally spaced apart and parallel support rods 98. When the seat assembly 12 is in its deployed position, as illustrated in FIG. 2, the support arms 97 are oriented generally horizontally and the support rods 98 are oriented generally vertically. Each of the support arms 97 has a first end 99 that is pivotally mounted to the third, forwardly oriented, corner 89 of the respective mount 84 and between the arms 86. A second end 101 of each of the support arms 97 terminates in a handle 102. When the seat assembly 12 is in its deployed position, the handles 102 project out from the front of the stair chair 10. The handles 102 are conventional and are slidable with respect to the associated support arms 97 between a retracted position and an extended position, the handles 102 being illustrated herein only in their retracted positions. A button 105 is included on a top surface of each of the handles 102. When the button 105 is depressed, a locking mechanism (not shown) within the respective support arm 97 is released, allowing the associated handle to be moved between its retracted and extended positions.

As illustrated in FIG. 2, each of the support rods 98 has a first upper end 103 that is pivotally mounted to the frame 91 by a conventional U-shaped bracket secured to the underside of the frame 91. A front wheel 14 is rotatably attached to a second lower end 104 of each of the support rods 98. The front wheels 14 are rotatable about an axis of rotation 106 on each wheel yoke 107 that can swivel about a vertically upright axis. Extending between the support rods 98 above the wheels 14 adjacent the second ends 104 is a foot rest 108 (FIG. 1). Each support arm 97 is pivotally attached to a respective one of the support rods 98 by a bolt or other suitable fastener 109. As illustrated, the attachment point of each support arm 97 and support rod 98 pair is just rearward of the handles 102. When the seat assembly 12 is in its retracted position, each support rod 98 is received by a respective one of the brackets 95 to lock the seat assembly 12 in its retracted position. When the seat assembly 12 is moved between its retracted and deployed positions, the support arms 97 and the support rods 98 pivot with respect to each other about a common pivot axle 111 formed by the fasteners 109. When the seat assembly 12 is moved to its deployed position, it is locked in its deployed position when the ends 29 of the rod 28 seat in the bottom of each track 31.

Returning to FIG. 1, the rail assembly 13 includes a pair of laterally spaced rail members 112. Each rail member 112 includes an upper end 113 and a lower end 114. Each of the rail members 112 has a front surface 116 (FIG. 2), a back surface 117 (FIG. 2), an inner facing surface 118 and an outer facing surface 119. Referring to FIG. 2, a bracket 121 is attached to the lower end 114 of each of the rail members 112 and supports thereon one of the back wheels 16 of the stair chair 10. A brake pedal 120 is attached to each bracket 121 and can be pivoted to lock or unlock the back wheels 16. The back wheels 16 are rotatable about a common axis of rotation 122. Each bracket 121 is pivotally connected to the second, lowermost corner 88 of the associated mount 84 between the arms 86 by a fastener 123 and for movement about a pivot axis 124.

Figure 3:
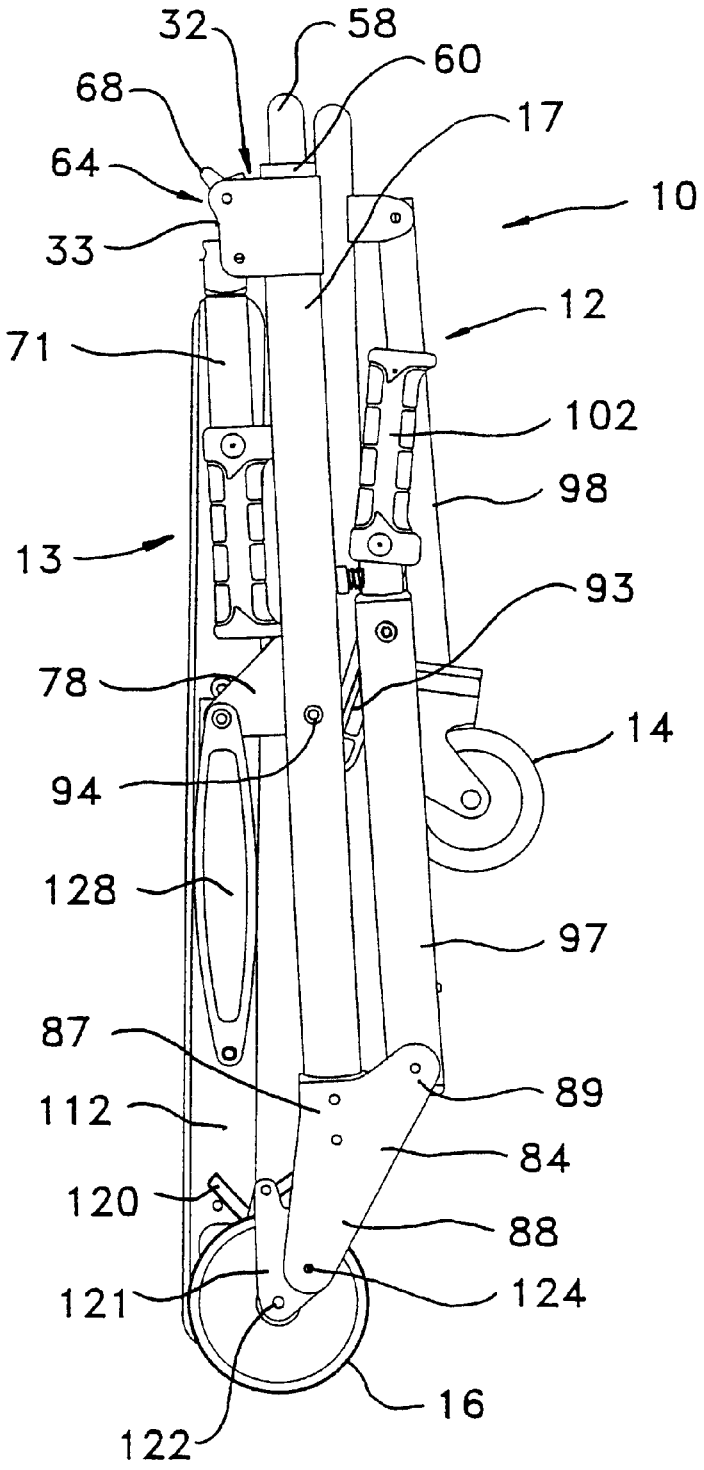
FIG. 3 is a side view of the stair chair of FIG. 1 in a fully retracted position.
Figure 4A:
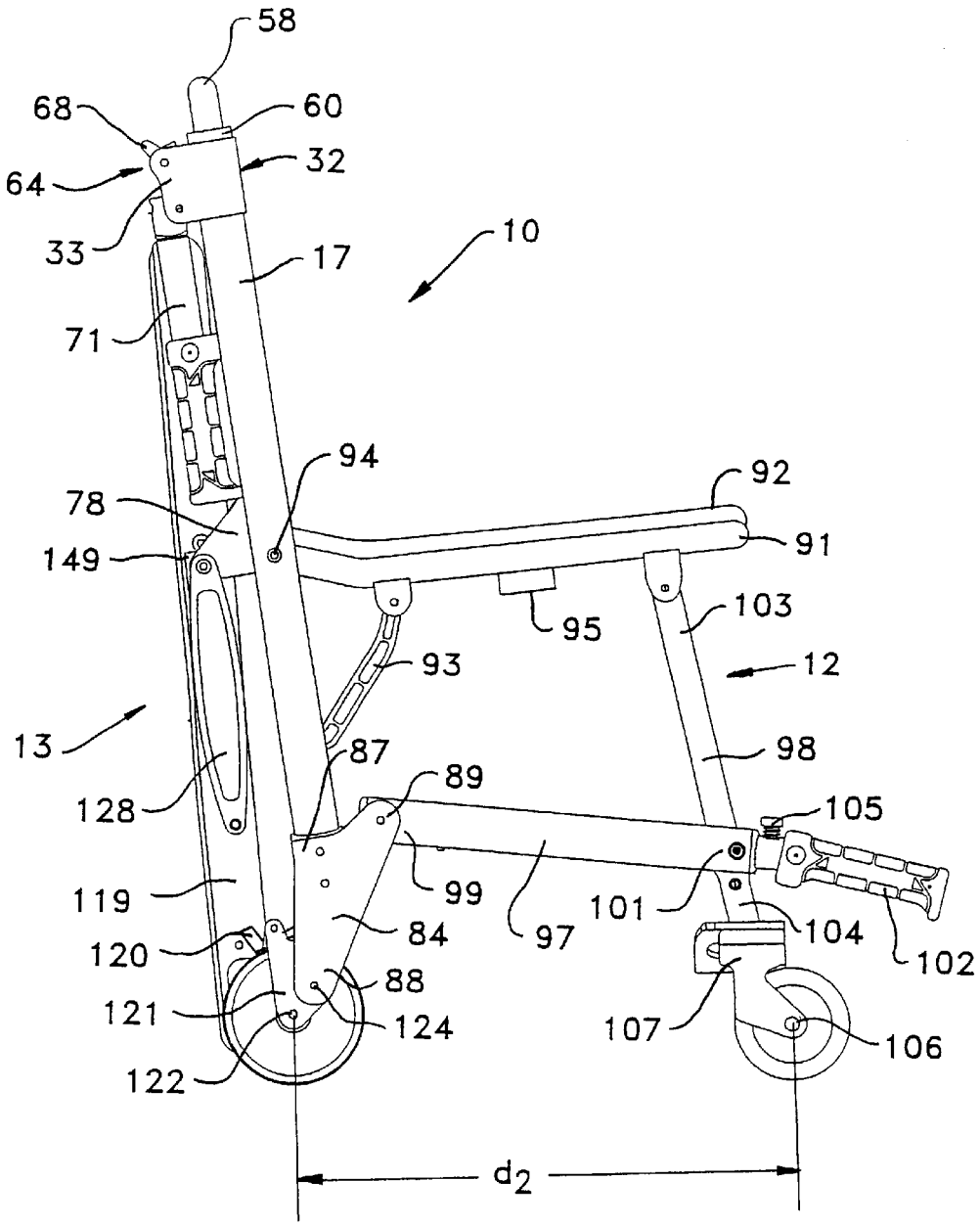
FIG. 4A is a side view of the stair chair of FIG. 1 with the seat assembly in a deployed position and the rail assembly in a retracted position.
Figure 4B:
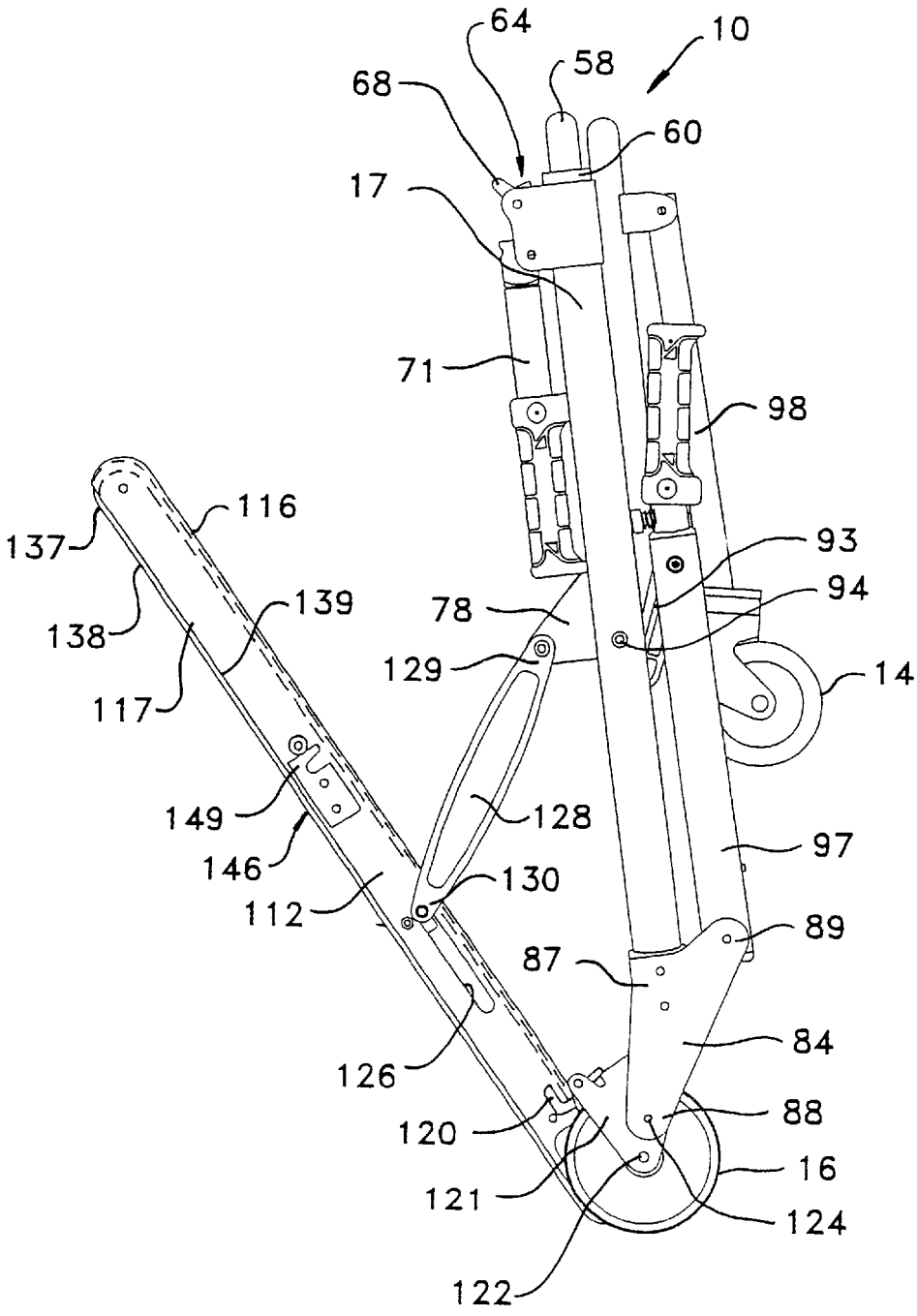
FIG. 4B is a side view of the stair chair of FIG. 1 with the seat assembly in a retracted position and the rail assembly in a deployed position.

The rail members 112 are pivotal together about the pivot axis 124 between retracted positions (FIGS. 3 and 4A) and deployed positions (FIGS. 1, 2 and 4B). When the rail members 112 are in their retracted positions, each rail member 112 is adjacent its respective upright 17 and the bracket 121 is in a first position with respect to the mount 84 (FIG. 4A). When the rail members 112 are in their deployed positions, the upper end 113 of each rail member 112 is inclined away from the rear of its respective upright 17 and the bracket 121 is in a second position with respect to the mount 84 (FIG. 4B), as best illustrated in FIG. 2.

Figure 7:
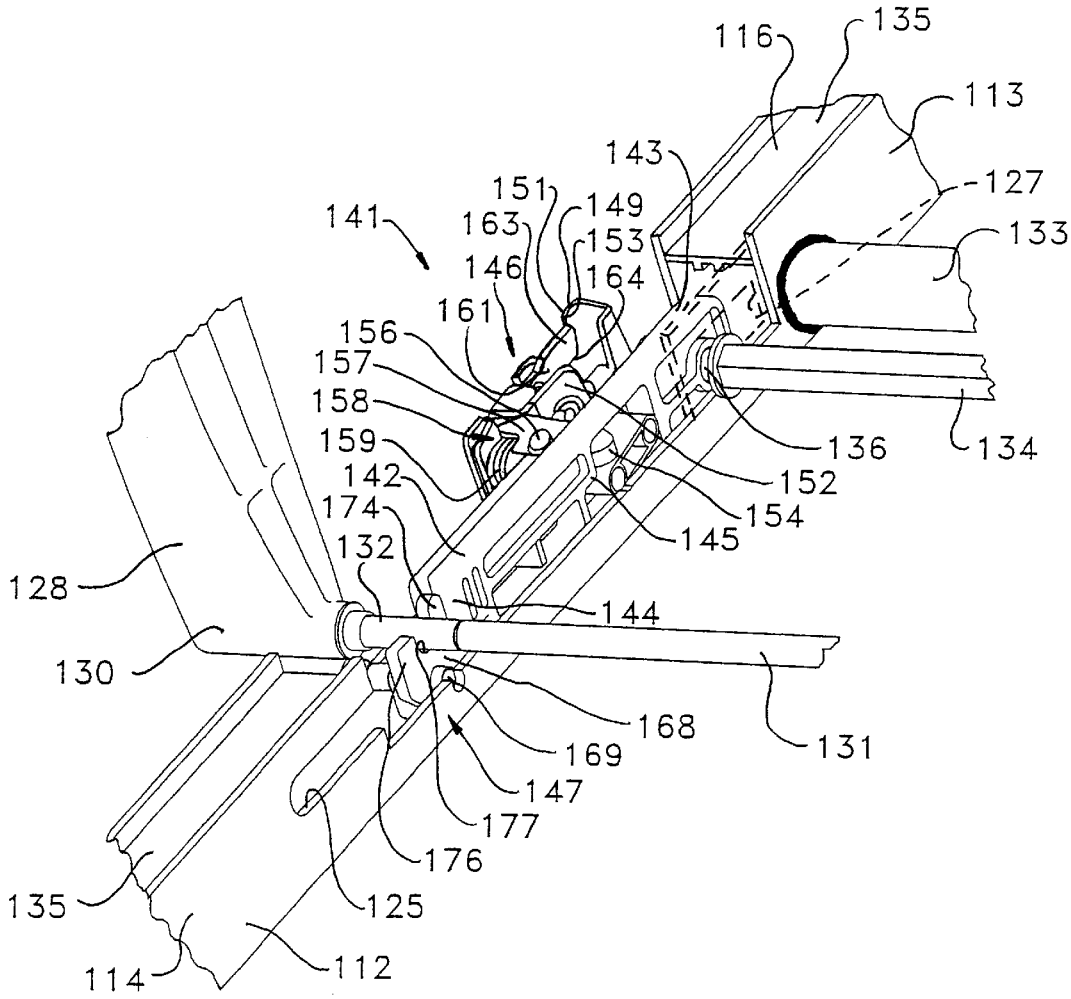
FIG. 7 is a sectioned perspective view of the latch assembly of the stair chair of FIG. 1.

As best illustrated in FIG. 1, parallel transverse slots 125 and 126 extend through the mid-section of the inner-facing and outer-facing surfaces 118 and 119, respectively of each of the rail members 112. The slots 125 and 126 are identical in size and shape. A transverse slot 127 extends through the inner-facing surface 118 of each of the rail members 112. Each rail member 112 is coupled to the respective upright 17 by a brace 128. Referring now to FIG. 2, each brace 128 has a first end 129 that is pivotally attached to the outer facing surface 81 of the end 82 of the bracket 78. A rod 131 (FIG. 1) extends between the second ends 130 of the braces 128. As best illustrated in FIG. 7, each end 132 of the rod 131 extends through transverse slots 125 and 126 in the associated rail member 112 and connects to the respective brace 128. The rod ends 132 are appropriately sized so that they can slide within the slots 125 and 126.

Returning to FIG. 1, the rail members 112 are coupled to one another by two rods 133 and 134. The rod 133 is fixed on either end to the inner facing surfaces 118 of the rail members 112 in a suitable manner, such as by welding. The rod 134 is positioned below the rod 133 and has ends 136 that extend through the slots 127 in the inner facing surfaces 118 of the rail members 112. Each end 136 of the rod 134 can slide within the associated slot 127 so that the rod 134 is moveable between an upward position, closer to the rod 133 and a downward position away from the rod 133.

Referring to FIG. 4B, an endless belt 137 extends over each rail member 112. The belt 137 includes a top surface 138 that is configured to engage the edges of one or more stairs. The belt 137 also includes a bottom surface 139 that is guided to roll transversely along the respective rail member 112 and is configured to advance the belt 137 along the rail member 112 as the stair chair 10 is moved down stairs. The belt 137 moves along a track 135 (FIG. 7) in the front surface 116 of the rail members 112. The rail members 112 are preferably sufficiently sized so that the belt 137 can engage the edge of at least two stairs at a time. The belts 137 and tracks 135 are similar to the belts disclosed in U.S. Pat. No. 4,473,234 which issued to Egen on Sep. 25, 1984 and is incorporated by reference herein.

Figure 10C:
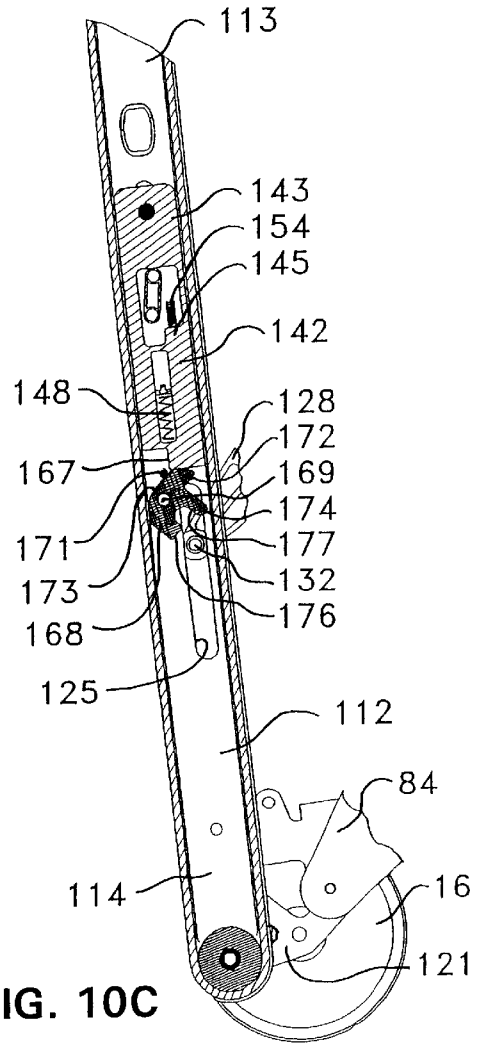
FIG. 10C is a sectioned side view of one rail member of the stair chair of FIG. 1 with the lower latch mechanism of the latch assembly in a third position.
Figure 10B:
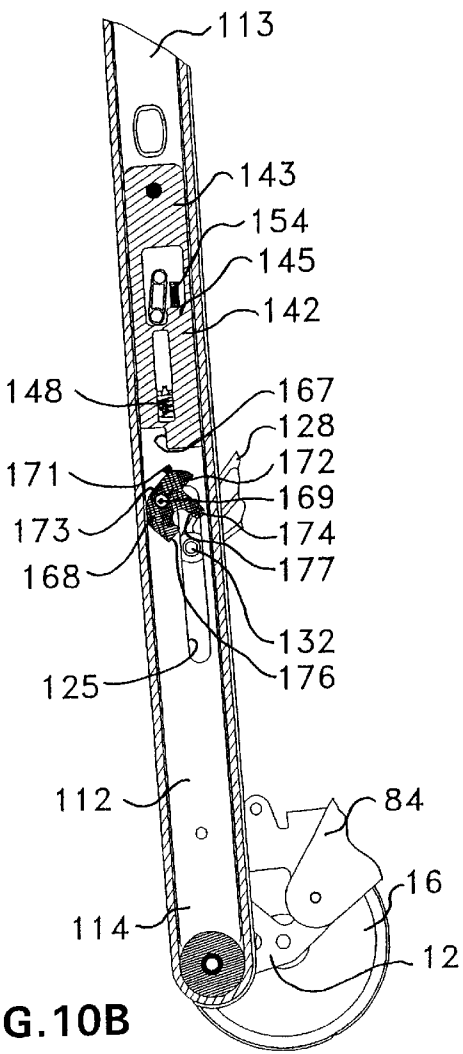
FIG. 10B is a sectioned side view of one rail member of the stair chair of FIG. 1 with the lower latch mechanism of the latch assembly in a second position.
Figure 10A:
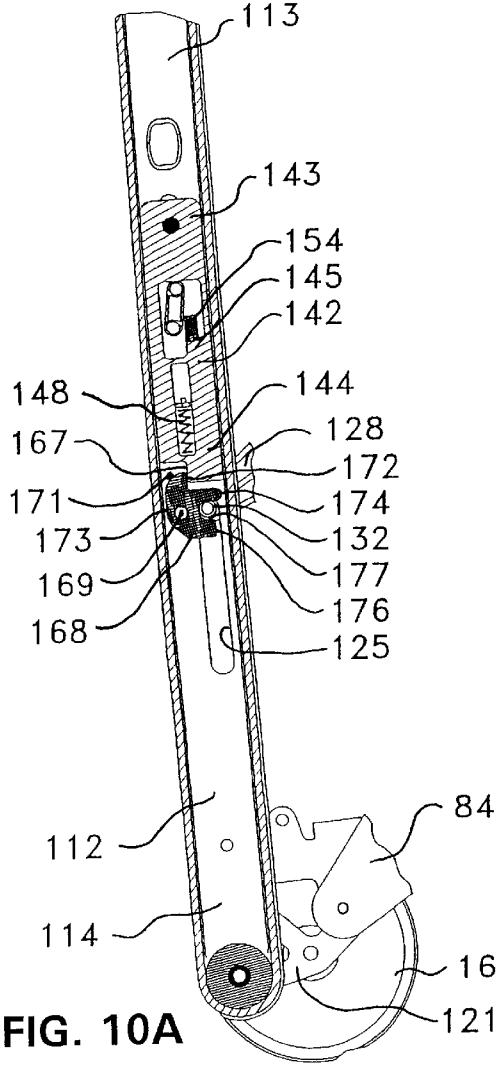
FIG. 10A is a sectioned side view of one of one rail member of the stair chair of FIG. 1 with the lower latch mechanism of the latch assembly in a first position.

Referring to FIG. 7, a cut-away view of one rail member 112 is illustrated. A latch assembly 141 is coupled to each of the rail members 112. Each latch assembly 141 includes a sliding member 142 that is slidably positioned in the respective rail member 112. An upper end 143 of each sliding member 142 is attached to one end 136 of the rod 134 which extends into the rail member 112 through the slot 127 (FIG. 1). A step 145 near the middle of the sliding member 142 is coupled to an upper latch mechanism 146 which is attached to the outwardly facing surface 119 of the associated rail member 112 (FIG. 1). A lower end 144 of each sliding member 142 is coupled to a lower latch mechanism 147 that is positioned in the interior of the respective rail member 112 (FIGS. 10A–10C). Each sliding member 142 is movable within the associated rail member 112 between an upper position and a lower position and is urged toward its lower position by a biasing spring 148 (FIGS. 10A–10C). Thus, when the rod 134 is moved toward its upward position, the sliding member 142 is moved upward against the force of the biasing spring 148. When the rod 134 is released, the sliding member 142 is returned to its lower position by the biasing spring 148, thus moving the rod 134 toward its downward position.

Figure 8B:
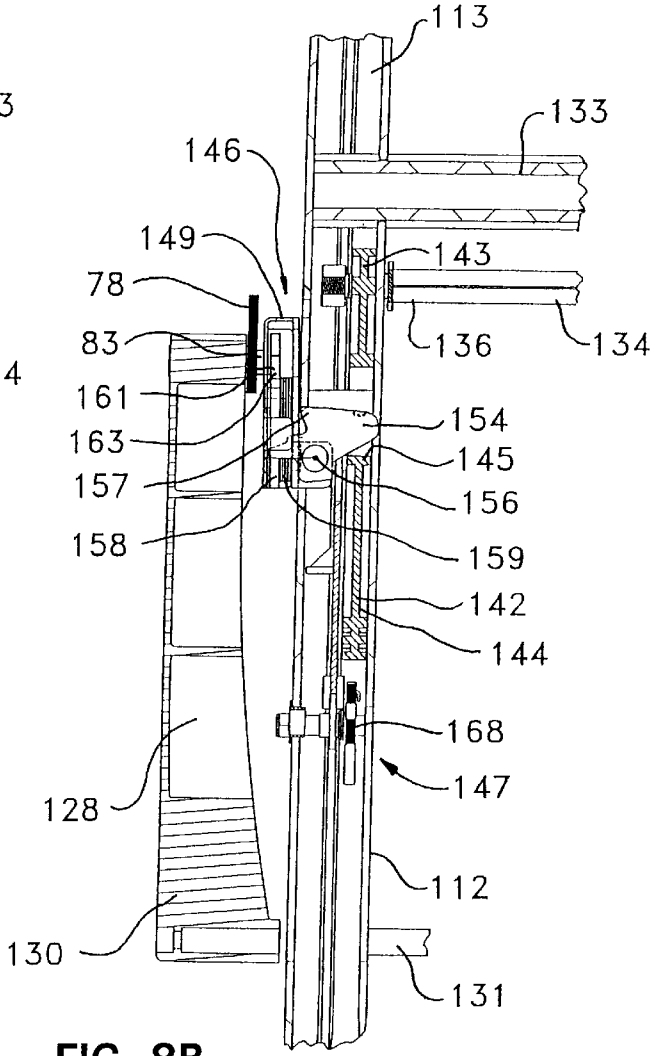
FIG. 8B is a sectioned side view of the main frame of FIG. 1 with the upper latch mechanism of the latch assembly disengaged from the rail member.
Figure 8A:
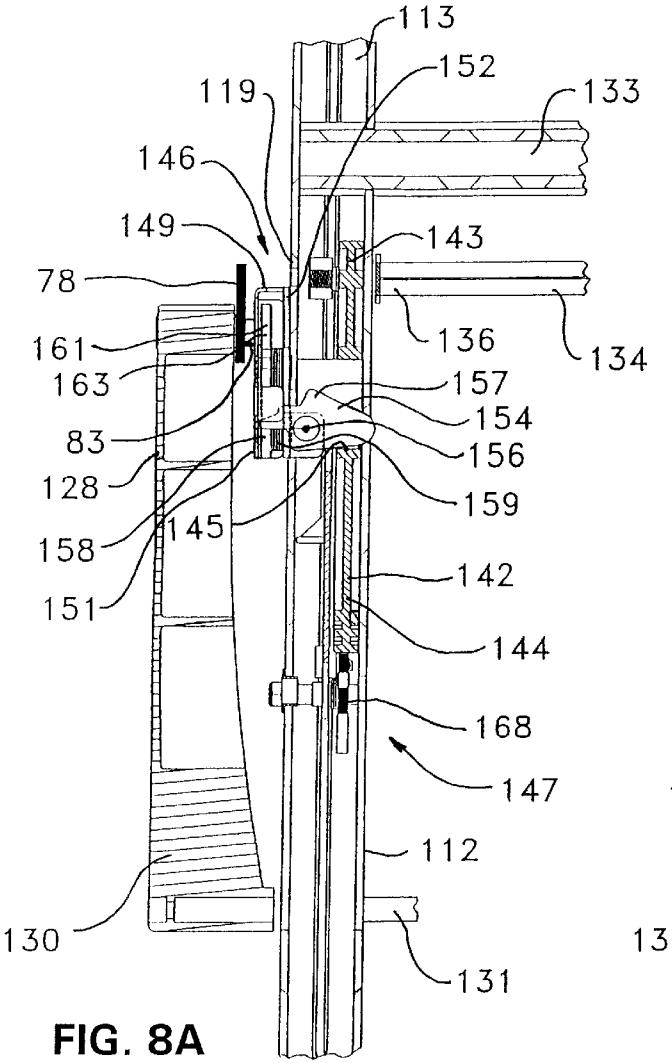
FIG. 8A is a sectioned side view of the stair chair of FIG. 1 with the upper latch mechanism of the latch assembly engaging one rail member.
Figure 9:
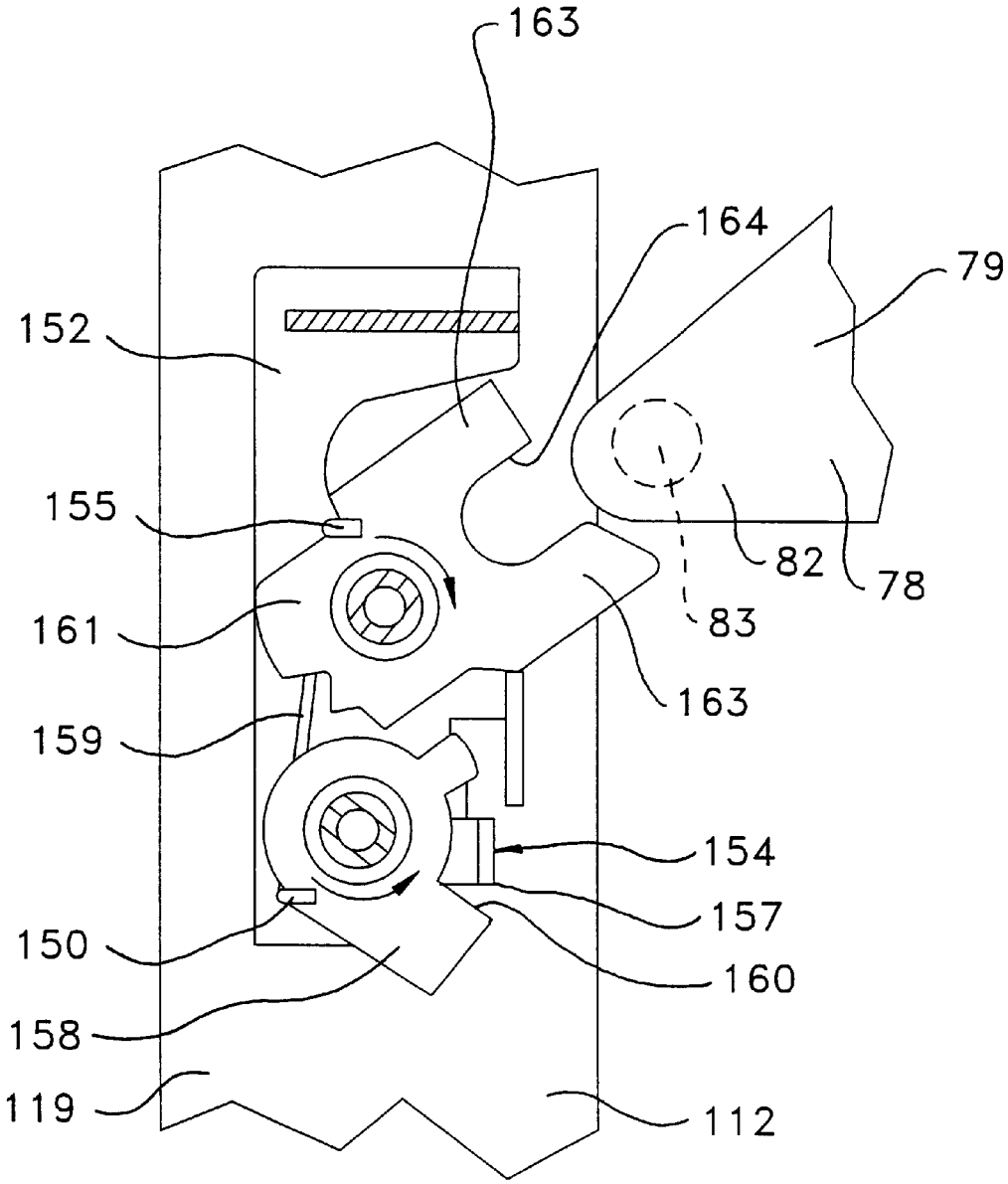
FIG. 9 is a sectioned side view of the upper latch mechanism of FIGS. 8A–8B illustrating the latch in an unlocking position.

Referring to FIGS. 8A, 8B and 9, the upper latch assembly 146 includes a conventional rotary latch 149. The rotary latch 149 is similar to the rotary latches disclosed in U.S. Pat. No. 5,439,260, which issued to Weinerman et al. on Aug. 8, 1995. The rotary latch 149 has a front surface 151 and a back surface 152 which are spaced apart by an opening 153 (FIG. 7). The rotary latch 149 is attached to the respective rail member 112 so that the back surface 152 is adjacent the outer-facing surface 119 of the associated rail member 112, as illustrated in FIG. 8A. A lever 154 projects from the back surface of each rotary latch 149 and extends into the respective rail member 112. Each lever 154 is secured to the respective rotary latch 149 by a fastener which forms a pivot axle 156 about which the associated lever 154 can pivot. Each lever 154 can pivot about the associated pivot axle 156 between a generally horizontal first position (FIG. 8A) and an upwardly inclined second position (FIG. 8B). Each lever 154 includes an arm 157 that extends into the latch housing 149.

As best illustrated in FIG. 9, a pawl 158 is rotatably mounted in each rotary latch 149. Each pawl 158 can pivot between a first position and a second position (illustrated in FIG. 9), and is urged toward its first position by a first arm 150 of a torsion spring 159. Each pawl 158 includes a groove 160 that is sized to receive the arm 157 of the respective lever 154.

A latch member 161 is secured between the front and back surfaces 151 and 152 of the rotary latch 149. Each latch member 161 has two arms 163 that are spaced apart by a groove 164. Each groove 164 is sized to receive the knob 83 on the upper end of the respective bracket 78 secured to one of the uprights 17. Each latch member 161 can pivot between a locking position in which the arms 163 are oriented vertically upward and the groove 164 is blocked from the opening 153 in the latch housing 149 and an unlocking position, illustrated in FIG. 9, in which the groove 164 is open to the opening 153. The latch member 161 is urged toward its unlocking position, which is illustrated in FIG. 9, by the a second end 155 of the spring 159. The latch member 161 is positioned in the rotary latch 149 so that the pawl 158 will hold the latch member 161 in its locking position against the force of the spring 159 when the pawl 158 is in its first position.

Returning to FIGS. 8A and 8B, when the sliding member 142 is in its lower position (FIG. 8A), the lever 154 is in its first position, the pawl 158 is in its first position and the latch member 161 is in its locking position. When the sliding member 142 is in its upper position (FIG. 8B), the step 145 of the sliding member 142 acts on the lever 154, causing the lever 154 to pivot about the pivot axle 156 toward its inclined second position. When the lever 154 moves toward this position, the arm 157 acts in the groove 160 of the pawl 158 to move the pawl 158 toward its second position against the bias of the spring 159. Once the pawl 158 is moved toward its second position, the latch member 161 is moved toward its unlocking position by the force of the spring 159.

Referring now to FIGS. 10A–10C, the lower latch mechanism 147 is preferably contained in the interior of the associated rail member 112. As illustrated, the lower end 144 of the sliding member 142 includes a step 167. A latch 168 is rotatably positioned within each rail member 112 beneath the sliding member 142. Each latch 168 is secured to the associated rail member 112 by a suitable fastener. Each latch 168 is rotatable about a pivot axle 169 formed by the fastener between locking and unlocking positions and is continuously urged toward its unlocking position by a torsion spring 171. A tab 172 extends upward from a top surface 173 of each latch 168. Two spaced apart arms 174 and 176 extend from a side surface 163 of the latch 168. The arm 174 is adjacent the top surface 173 of the latch 168 and is longer than the arm 176, which extends from the mid-section of the latch 168. The arms 174 and 176 are spaced apart by a groove 177. Each latch 168 is positioned within the associated rail member 112 so that the groove 177 is adjacent the top of the transverse slot 126 in the outer-facing surface 119 of the rail member 112. Each groove 177 is sized to receive an end 132 of the rod 131 (FIG. 7) which extends through the slots 125 and 126 from the brace 128.

Operation

When the stair chair 10 is not in use, the seat assembly 12 and the rail assembly 13 can be maintained in their respective retracted positions, as illustrated in FIG. 3. To seat a person in the stair chair, the seat assembly 12 is rotated about its pivot axis 94 to its deployed position, as illustrated in FIG. 4A. As the seat assembly 12 pivots, the rod 28 (FIG. 1) slides downward in the tracks 31 until the rod ends 29 seat in the bottom of the tracks 31 and the support arms 97 and the support rods 98 pivot about the pivot axle 111 (FIG. 2). The stair chair 10 can now be positioned upright with both the front wheels 14 and the rear wheels 16 in contact with the floor or ground surface. Note the stair chair 10 does not include any components that couple the rotation of the seat assembly 12 to the rotation of the rail assembly 13. Thus, the seat assembly 12 can be rotated about its pivot axis 94 to its deployed position without a corresponding rotation of the rail assembly 13 about its pivot axis 124. Similarly, the rail assembly 13 can be pivoted about its axis 124 to its deployed position without a corresponding rotation of the seat assembly 12 about its pivot axis 94, as illustrated in FIG. 4B.

When the stair chair 10 is to be moved along a flat surface, it will usually be preferable to leave the rail assembly 13 in its retracted position. As illustrated in FIG. 4A, when the rail assembly 13 is in its retracted position, the axis of rotation 122 of the back wheels 16 is spaced a first distance $d_1$ from the axis of rotation 106 of the front wheels 14. However, when the rail assembly 13 is deployed, as illustrated in FIG. 2, the axis of rotation 122 of the back wheels 16 is spaced a second, smaller distance $d_2$ from the axis of rotation 106 of the front wheels 14. Thus, a wheel base of the stair chair 10 is greater when the rail assembly 13 is in its retracted position than when it is in the deployed position. This configuration will increase stability when the stair chair 10 is being moved along a level surface and the rail assembly 13 is retracted.

When the stair chair 10 is in the FIG. 4A configuration, a user could rotate the handles 71 from their rest positions to their use positions to aid in pushing the stair chair 10. To lock one of the handles 71 in its use position (FIG. 6B), the handle 71 is rotated about its pivot axle 74. As the handle 71 is pivoted, the first end 72 contacts the latch end 69 of the locking element 64. The first end 72 pushes on the latch end 69 to rotate the locking element 64 toward its second position about the pivot axle 66. Once the handle 71 nears its use position, the first end 72 moves out of contact with the latch end 69 of the locking element 64, allowing the locking element 64 to be returned to its first position by the spring 67. As the locking element 64 returns to its first position, the latch end 69 seats in the notch 77 in the top surface 76 of the associated handle 71 (FIG. 6C). Once the latch end 69 is seated in the notch 77, the handle 71 is prevented from rotating from its use position and is thus locked in its use position. The other handle 71 can be moved to its use position in an identical manner. A user can then grasp the handles 71 and push the stair chair 10 along the flat surface.

To return the handles 71 to their rest positions, the tab end 68 of each locking element 64 is pulled downward to rotate the locking element 64 about the pivot axle 66 toward its second position, disengaging the respective latch end 69 from the notch 77 (FIG. 6B). Each handle 71 is then pivoted downward about its pivot axle 74 toward its rest position. Release of each tab end 68 will allow the respective locking element 64 to return to its biased, first position under the urging of the spring 67 (FIG. 6A).

To use the stair chair 10 to transport a person down one or more steps, the rail assembly 13 is unlocked from its retracted position and rotated to its deployed position (FIG. 4B). To unlock the rail assembly 13 from its retracted position, the rod 134 is pulled upward toward the rod 133. Referring to FIGS. 7–9, when the rod 134 is pulled upward, the sliding member 142 is pulled toward its upper position. The step 145 of the sliding member 142 acts on the lever 154 to push the lever 154 to rotate to its inclined position about the pivot axle 156 (FIG. 8B). As the lever 154 rotates toward this position, the arm 157 of the lever 154 engages the pawl 158 (FIG. 8B) in the latch housing 149 and pushes the pawl 158 toward its second position. When the pawl 158 moves toward its second position, the latch member 161 is forced toward its unlocking position by the spring 159, as illustrated in FIG. 9. Thus, each knob 83 (FIG. 8B) can slide out of the respective groove 64 as the rail members 112 are pulled away from the uprights 17. Once the knobs 83 have moved out of the groove 164, the rail members 112 can be pulled outward to their deployed positions.

As the rail members 112 are pulled outward, the rod ends 132 attached to the braces 128 are pulled upward in their respective pair of slots 125 and 126 (FIG. 10B). When the rail members 112 near their fully deployed positions, each end 132 of the rod 131 approaches the top of the associated slots 125 and 126. Each latch 168 is in its biased, unlocking position at this time. As the rod 131 continues to move upward, each rod end 132 seats in the groove 164 in the respective latch 168 to engage the latch 168 and move it to its locking position against the force of the biasing spring 171. The rod 134 can now be released. Once the rod 134 is released, an upward force is no longer acting on the sliding members 142. Thus, the sliding members 142 are returned to their downward positions under the force of the respective springs 148. The step 167 on the lower end 144 of each sliding member 142 engages the tab 172 on the top surface 173 of the associated latch 168 and holds the latch 168 in the locking position against the urging of the spring 171 (FIG. 10A). The rod ends 132 are now locked against the upper surface of the slots 125 and 126 by the arm 176 of the respective latch 168, thus locking the rail members 112 in their deployed positions.

The rail members 112 now project from the back of the stair chair 10. When the rail members 112 are in their deployed positions, the stair chair 10 can be tilted so that the belts 137 can engage the stairs. The stair chair 10 can be guided down the stairs. As the stair chair 10 moves down the stairs, the endless belts 137 will glide continuously along each rail member 112.

To transport the stair chair 10 down stairs, the handle 58 can be pulled to one of its extended positions to allow for greater control of the stair chair 10. When the handle 58 is in its rest position, as illustrated in FIG. 5A, a majority of each handle end segment 59 is contained within the recess 38 of the respective upright 17. When the stair chair 10 is configured as illustrated, the handle 58 can be locked in one of two extended positions. However, it should be appreciated that the handle 58 could be configured to be locked in any desirable number of positions.

Figure 11:
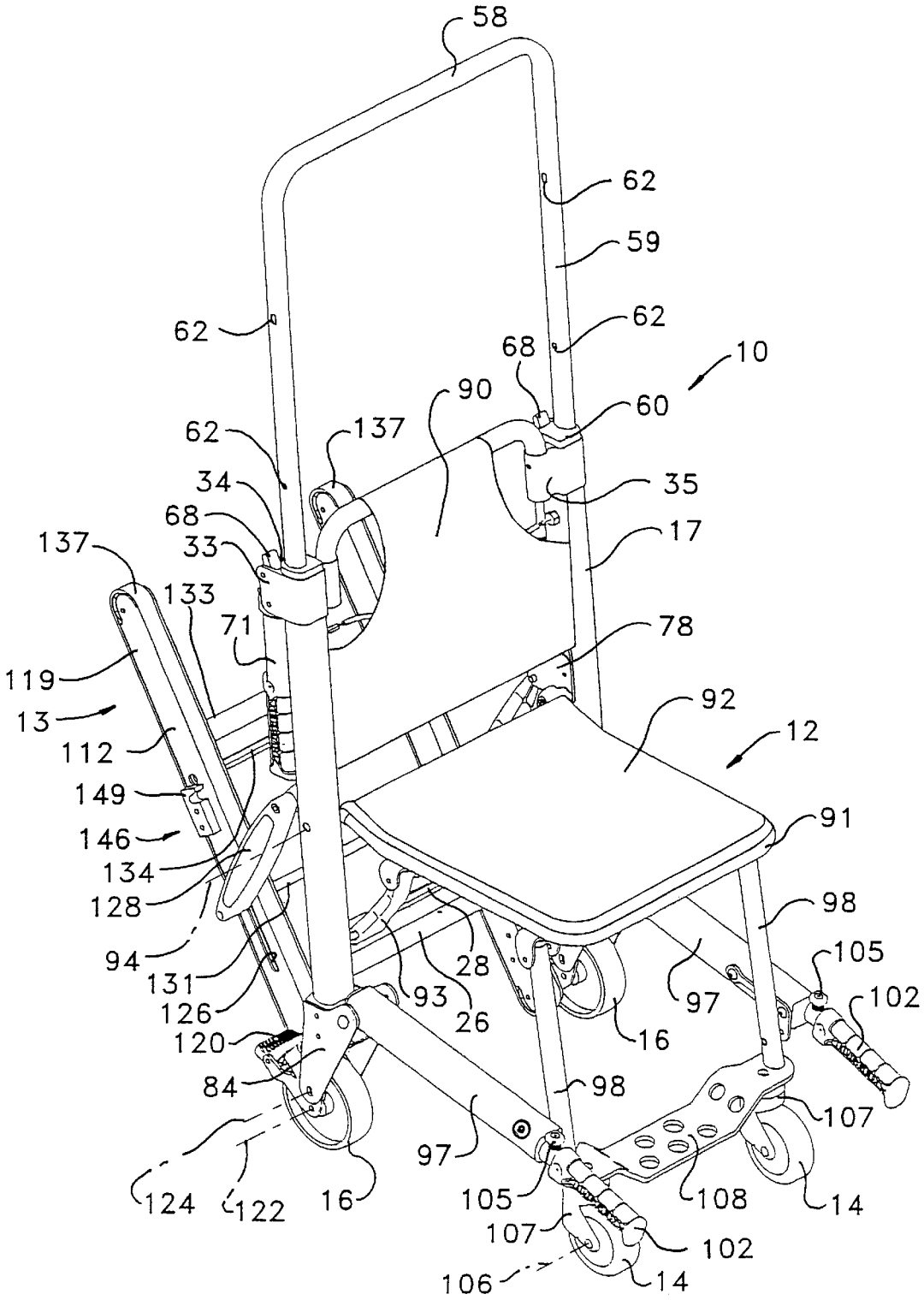
FIG. 11 is an elevated perspective view of the stair chair of FIG. 1 with the grab handle in the fully extended position.

Referring to FIGS. 5A and 5B, to lock the handle 58 in one of the extended positions, such as the position illustrated in FIG. 11, the connector 54 is pulled, causing an outward force to be applied to the end caps 56. As the end caps 56 are pulled outward, the bits 49 are pulled out of the bores 62 of the respective handle end segments 59 against the force of the springs 46. The handle 58 can then be pulled upward. As the handle 58 is pulled upward, the connector 54 can be released. The bits 49 will then be moved outward by the associated springs 46. As the handle 58 is pulled outward, the head 53 of each bit 49 will engage one of the bores 62. The bit 49 will then be moved to its fully extended position by the associated spring 46 to seat in the respective bore 62. Once the bits 49 are seated in the bores 62, the handle 58 will be locked in position.

Once the stair chair 10 has been moved down the stairs, the handle 58 can be returned to its lowermost position and the rail members 112 can be returned to their retracted positions. To unlock the handle 58 from this extended position, the flexible connector 54 is pulled, causing each bit 49 to be pulled out of engagement with the respective bore 62 against the force of the its spring 46. Once the bits 49 are disengaged from the bores 62 in the handle end segments 59, the handle 58 can be pushed downward to slide the end segments 59 into the recesses 38 of the uprights 17. The connector 54 can be released to allow the springs 46 to urge the bits 49 back toward their extended positions. Once the handle 58 has been lowered a sufficient distance, the heads 53 of the bits 49 will engage one set of the bores 62. As the bits 49 move into engagement with the bores 62, the heads 53 will be pushed into the bores 62 by the force of the springs 46.

Referring to FIGS. 10A–10C, to release the rail members 112 from their deployed positions, the rod 134 is pulled upward, moving each sliding member 142 toward its upward position (FIG. 10B). When the sliding member 142 is raised, the step 167 is moved out of engagement with the tab 172 of the latch 168. The latch 168 is now rotated about its pivot axle 169 toward its unlocking position by the spring 171. The ends 132 of the rod 131, which are no longer locked in the grooves 177 of the latches 168, can slide downward in the slots 125 and 126 when the rail members 112 are pushed toward the uprights 17.

Referring in addition to FIGS. 8A and 8B, since each sliding member 142 is in its upper position, the step 145 of each sliding member 142 is acting on the associated lever 154 to push the lever 154 toward its inclined second position. The pawl 158 is once again moved toward its second position by the arm 157 of the lever 154 and the latch member 161 is in its unlocking position. As the rail members 112 are moved toward their fully retracted positions, each knob 83 seats in the groove 164 of the associated latch member 161. As each rail member 112 is pushed toward the respective upright 17, the force of the knob 83 acting on the associated latch member 161 moves the latch member 161 toward its unlocking position against the force of the spring 159. The rod 134 can then be released so that the sliding members 142 return to their downward positions under the force of the biasing springs 148. When the sliding members 142 move downward, the levers 154 are returned to their biased, first positions. As each lever 154 moves toward its first position, the respective pawl 158 is returned to its first position by the spring 159 to lock the associated latch member 161 in its unlocking position. Each knob 83 is now locked between the arms 163 of the latch member 161 so that the rail members 112 are locked in their retracted positions.

Once the rail members 112 have been returned to their retracted positions, the stair chair 10 can be moved over a flat surface, or carried up one or more steps if desired. Of course, it should be appreciated that the stair chair 10 can be moved over a flat surface, such as a landing between flights of stairs, with the rail members 112 in their deployed positions. However, certain users may find it easier to control the stair chair when the rail members 112 are retracted. In addition, since the wheel base of the stair chair 10 is larger when the rail members are in their retracted positions, the stair chair 10 will have a greater stability when the rail members are not deployed.

The stair chair 10 could also be carried up stairs once the rail members 112 are moved to their retracted positions. To carry the stair chair 10 up one or more steps, the handles 71 are move to their use position, as previously described. A single operator can then carry the stair chair 10 up the steps. Since the rail members 112 can be retracted while the stair chair 10 is in use, the rails will not interfere with this action.

When use of the stair chair 10 is complete, the seat assembly 12 can be rotated back to its retracted position. Each support rod 98 is received in its respective bracket 95 to lock the seat assembly 12 in its retracted position. The stair chair 10 is now folded into a convenient position for storage, as illustrated in FIG. 3.

It should be appreciated that the foregoing description is for the purposes of illustration only, and further alternative embodiments of this invention are possible without departing from the scope of the claims. Thus, although particular preferred embodiments of the present invention have been disclosed in detail for illustrative purposes, it will be recognized that variations or modifications lie within the scope of the present invention and do not depart from the spirit of the invention, as set forth in the foregoing description and drawings, and in the following claims.

What is claimed is:

1. A stair chair comprising:

a main frame;

a seat assembly mounted to said main frame and configured to pivot about a first pivot axis;

said seat assembly including a seat and a support frame pivotally mounted to said main frame wherein at least two laterally spaced front wheels are rotatably attached to a lower end of said support frame;

a rail assembly, at least two laterally spaced brackets provided at a lower end of said rail assembly, each said bracket having a back wheel rotatably supported thereon about a common axis of rotation;

at least two mounts provided at a lower end of said main frame, each of said mounts being configured to pivotally connect one of said brackets to said main frame for movement about a second pivot axis;

said rail assembly being configured to pivot about said second pivot axis independent of movement of said seat assembly and said seat assembly being configured to pivot about said first pivot axis independent of movement of said rail assembly; and a first spacing between an axis of rotation of said front wheels and said axis of rotation of said back wheels when said rail assembly is in a retracted position and a second spacing between said axis of rotation of said front wheels and said axis of rotation of said back wheels when said rail assembly in a deployed position.

2. The stair chair according to claim 1, wherein said axis of rotation of said back wheels is positioned rearward of said second pivot axis.

3. The stair chair according to claim 1, wherein said rail assembly includes first and second laterally spaced rail members that are mounted to said main frame and are configured to pivot in unison about said second pivot axis between said retracted and deployed positions.

4. The stair chair according to claim 3, wherein said axis of rotation of said back wheels is moveable about said second pivot axis when said first and second rail members are moved between said retracted and deployed positions.

5. The stair chair according to claim 4, wherein said axis of rotation is spaced a first distance from a back side of said main frame when said first and second rail members are in said deployed positions; and said axis of rotation is spaced a second distance greater than said first distance from said back side of said main frame when said first and second rail members are in said retracted positions.

6. The stair chair according to claim 3, wherein said main frame includes first and second laterally spaced apart uprights; and said rail assembly includes first and second connecting members, an upper end of each of said first and second connecting members is bracketed to a respective one of said first and second uprights and a lower end of each of said first and second connecting members is slidably mounted to a respective one of said first and second rail members.

7. The stair chair according to claim 6, including first and second latch assemblies respectively coupled to said first and second rail members and configured to lock said first and second rail members in at least one of a retracted position and a deployed position; and an elongate rod extends between said first and second rail members and has a first end attached to said first latch assembly and a second end attached to said second latch assembly.

8. The stair chair according to claim 7, wherein said first and second latch assemblies are configured to respectively engage said upper ends of said first and second connecting members when said first and second rail members are in said retracted positions; and said first and second latch assemblies are configured to respectively engage said lower ends of said first and second connecting members when said first and second rail members are in said deployed positions.

9. The stair chair according to claim 8, wherein each of said first and second latch assemblies includes a lower latch mechanism positioned at least partially in a respective one of said first and second rail members; and each lower latch mechanism includes a spring biased latch configured to respectively engage a projection extending from said lower end of said first and second connecting members.

10. The stair chair according to claim 9 wherein each of said first and second latch assemblies includes an upper latch mechanism positioned at least partially on an outer surface of a respective one of said first and second rail members and configured to respectively engage a projection extending from said upper end of said first and second connecting member.

11. The stair chair according to claim 1, wherein said main frame includes a first upright having a first upper recess and a second upright having a second upper recess; and a generally U-shaped grab handle extends between said first and second uprights and has a first end received in said first upper recess and a second end received in said second upper recess.

12. The stair chair according to claim 11, wherein said first and second ends of said grab handle are slidably received in said first and second upper recesses and said grab handle is movable between lowered and extended positions;

a first bore extends through said first upright into said first upper recess and a second bore extends through said second upright into said second upper recess;

a plurality of openings extend along a length of each of said first and second ends of said grab handle, each configured to move into and out of axial alignment with a respective one of said first and second bores; and a first pin extends through said first bore and into one of said openings in said first end and a second pin extends through said second bore and into one of said openings in said second end to lock said grab handle in one of said lowered and extended positions.

13. The stair chair according to claim 1, including two spaced apart handles pivotally attached to a back side of said main frame, each handle being configured to pivot between rest and use positions.

14. The stair chair according to claim 13, including spring biased locking elements respectively coupled to each of said handles and configured to lock each of said handles in said use position.

15. The stair chair according to claim 1, wherein the rail assembly includes first and second laterally spaced apart rail members; and endless belts respectively extend over each of said first and second rail members, wherein each endless belt includes coextensive mating surfaces that are configured to engage at least two stairs.

* * * * *